US007700860B2

(12) United States Patent
Nagayama

(10) Patent No.: US 7,700,860 B2
(45) Date of Patent: Apr. 20, 2010

(54) KEYBOARD INSTRUMENT AND FALLBOARD STRUCTURE THEREOF

(75) Inventor: Akihiro Nagayama, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 11/652,714

(22) Filed: Jan. 12, 2007

(65) Prior Publication Data

US 2007/0163417 A1 Jul. 19, 2007

(30) Foreign Application Priority Data

Jan. 16, 2006 (JP) ..... 2006-007907
Jan. 16, 2006 (JP) ..... 2006-007908
Jan. 16, 2006 (JP) ..... 2006-007909

(51) Int. Cl.
*G10C 3/02* (2006.01)

(52) U.S. Cl. ..... 84/179; 84/423 R

(58) Field of Classification Search ..... 84/179, 84/174–177; 312/100, 109, 138.1, 326, 260, 312/270.1

See application file for complete search history.

(56) References Cited

U.S. PATENT DOCUMENTS 4,694,723 A 9/1987 Shinohara
5,907,115 A * 5/1999 Matsunaga et al. ..... 84/477 R
6,380,470 B1 4/2002 Fujiwara et al.
6,673,991 B2 * 1/2004 Hara ..... 84/179
2003/0221537 A1 12/2003 Kenichiro
2004/0182223 A1 9/2004 Kuwahara et al.

FOREIGN PATENT DOCUMENTS

| | | |
|---|---|---|
| DE | 100 18 052 | 12/2000 |
| JP | 07-49511 | 11/1995 |
| JP | 10-039868 | 7/1996 |
| JP | 08-314435 | 11/1996 |
| JP | 11-065552 | 3/1999 |
| JP | 2004-302419 A | 10/2004 |
| JP | 2005-221543 | 8/2005 |
| JP | 2005-292415 | 10/2005 |
| JP | 2000-181455 | 6/2006 |

OTHER PUBLICATIONS

Roland: "Roland Digital Piano RG-7," Product Brochure, Mar. 2005, Japan , p. 1-4, Simple Elegant Panel with Locking Lid Convenient New Features for Commercial Facilities.

* cited by examiner

*Primary Examiner*—Jianchun Qin
(74) *Attorney, Agent, or Firm*—Morrison & Foerster LLP

(57) ABSTRACT

A fallboard structure of a keyboard instrument capable of selectively shielding or opening the inside of the instrument from or toward a player. A fallboard covers a keyboard section when it is closed, and permits the keyboard section to be operated for performance when it is open. A front plate pivotally supports the fallboard and shields a space upward and rearward of the keyboard section against a player when it is in a first state. When the fallboard is made open and engaging portions of the front plate are moved along displacement guides provided at supporting portions disposed at side portions of a keybed, the front plate is moved in unison with the fallboard and changed to a second state where the space upward and rearward of the keyboard section is open toward the player.

10 Claims, 11 Drawing Sheets

KEYBOARD INSTRUMENT AND FALLBOARD STRUCTURE THEREOF

BACKGROUND OF THE INVENTION

1. Field of the invention

The present invention relates to a keyboard instrument and a fallboard structure thereof, and more particular, to a fallboard structure including a fallboard that covers a keyboard section, and a keyboard instrument having an optical display section for performance assist or the like.

2. Description of the Related Art

Conventionally, piano-based electronic keyboard instruments have been known that include an ingenious fallboard structure, as disclosed in Japanese Utility Model Publication (Kokoku) No. H07-49511 and Japanese Patent Laid-open Publication (Kokai) No. 2004-302419 (hereinafter referred to as first and second prior arts, respectively). In some piano-based electronic keyboard instruments, much efforts have been made to provide an acoustic piano-like appearance and performance feeling. Such efforts have been made to improve a fallboard structure as well as various parts such as tone generator system, keyboard mechanism, and exterior mechanism.

The acoustic piano has a long history and a general concept thereof is fixed such as, for example, as follows: Piano actions are disposed rearward and upward of keys. A front plate is disposed rearward and upward of a keyboard section, and the piano actions and the like in an instrument body are hidden by the front plate. Further, a fallboard provided solely to cover the keyboard section is adapted to be raised and superimposed on the front plate in a facing relation therewith when it is open.

A piano-based electronic keyboard instrument of a type not provided with the just mentioned external and structural features that are proper to the acoustic piano is no longer recognized as belonging to the acoustic piano.

For example, the keyboard instrument according to the first prior art is designed that the fallboard covering the keyboard section can be opened and closed by being slid in a front-to-rear direction. However, the fallboard motion and the external appearance of the fallboard after being opened quite differ from those of the acoustic piano. In the keyboard instrument according to the second prior art, an operation panel is provided on a rear surface of the fallboard. At the time of operation for performance, the fallboard is made open and the operation panel is exposed for operation. This keyboard instrument differs in external appearance from the acoustic piano.

By the way, it is expected that musical tones can be effectively sounded by making a tone generator section such as a sound board and strings disposed rearward of the keyboard open not only toward upward but also toward the player.

In addition to the first prior art, there is known a keyboard instrument having a fallboard structure in which the fallboard covering the keyboard section is housed in the instrument body when the fallboard is open, as disclosed in Japanese Patent Publication (Kokai) No. H11-65552 (hereinafter referred to as the third prior art).

For example, in the fallboard structure according to the first prior art, the fallboard is slidingly moved rearward and housed in the instrument body. In the fallboard structure according to the third prior art, the fallboard is adapted to be folded on the front plate such that the front plate is moved rearward with the progress of opening the fallboard.

With the fallboard structures according to the first and third prior arts, however, the fallboard at the time of being opened interferes with a space rearward and upward of the keyboard section. Thus, the space rearward and upward of the keyboard section must always be left unoccupied, making it impossible to dispose functional element parts of the keyboard instrument in that space, which is disadvantageous from the viewpoint of space-saving.

Further, there is known a keyboard instrument having optical displays for optical performance assist or the like that are provided so as to correspond to respective ones of the keys, as disclosed in Japanese Laid-open Patent Publication No. 2000-181455 (hereinafter referred to as the fourth prior art). In the fourth prior art, optical bodies, as optical displays, made of a transparent resin are each disposed on a rear end of an exposed upper surface portion of a corresponding one of the keys, for example. Light emitted from a light-emitting body is diffused by a corresponding optical body and then emitted from a front surface and an upper slanted surface of the optical body, to be recognized by the player.

With the fourth prior art, however, the optical bodies exposed at the time of musical performance are always visible from the player and only recognized as emitting light. As a result, the presence of the optical bodies are always conscious and the entire instrument is recognized as an electronic musical instrument.

Thus, even when this keyboard instrument is fabricated such that the instrument body has its external appearance as close as possible to that of the acoustic piano, there still remains the concept of an electronic instrument at least at the time of musical performance, making it difficult to realize a musical performance with an acoustic piano-like appearance.

Furthermore, an electronic keyboard instrument must have a panel section in which electronic instrument's functional elements such as operators are disposed. Thus, the electronic keyboard cannot be recognized as being similar to the acoustic piano, if there is no element corresponding to the front plate on the rear side of the keyboard section. For example, when a panel section is disposed at a location where the front plate is usually disposed, the panel section is always visible from the player, which puts the electronic instrument away from having an acoustic piano-like appearance.

Nevertheless, when utilized for performance assist or the like, the optical displays must be visible without difficulties. Further, the electronic keyboard instrument must have user-friendliness for operation of the panel section.

SUMMARY OF THE INVENTION

A first object of the present invention is to provide a fallboard structure of a keyboard instrument capable of selectively shielding or opening the inside of the instrument from or toward a player at the time of musical performance.

A second object of the present invention is to provide a fallboard structure of a keyboard instrument in which a fallboard can be housed within an instrument body so as not to interfere with a space rearward and upward of the keyboard section, thereby securing an installation space for instrument component parts in the space rearward and upward of the keyboard section.

A third object of the present invention is to provide a keyboard instrument that is capable of selectively carrying out a musical performance in which the presence of light-emitting function is not conscious and a musical performance in which emitted light is made visible, and capable of selectively shielding or opening the inside of the instrument against or toward a player at the time of musical performance.

To attain the first object, according to a first aspect of the present invention, there is provided a fallboard structure of a keyboard instrument including an instrument body (101), a keybed (21) having side portions and provided in the instrument body, and a keyboard section (KB) having a rear portion (KBa) and provided in the instrument body, the fallboard structure comprising a pair of left and right supporting portions (23, 22) fixed to the keybed of the instrument body and respectively disposed at the side portions of the keybed, a fallboard (60) capable of being selectively made in a closed state and an open state, the fallboard covering the keyboard section when it is in the closed state and permitting the keyboard section to be operated for performance when it is in the open state, a front plate (65) having side portions and at least one pivot shaft (63) and having a width thereof at least equal to that of the keyboard section, the front plate being capable of having at least first and second states of posture, the front plate supporting the fallboard so as to be pivotable around the pivot shaft in opening and closing directions and shielding a space upward of the rear portion of the keyboard section against a player when it is in the first state of posture, a pair of left and right engaging portions (69) provided at the side portions of the front plate, and a pair of left and right displacement guides (45) provided in inner sides of respective ones of the supporting portions so as to correspond to the engaging portions, wherein when the fallboard is made in the open state and each of the engaging portions of the front plate is caused to move along a corresponding one of the displacement guides, the front plate is caused to move in unison with the fallboard and changed over from the first state of posture to the second state of posture, whereby the space upward of the rear portion of the keyboard section is made open toward the player.

With this construction, at the time of a musical performance, the inside of the instrument can be selectively made shielded against the player or open toward the player.

To attain the first object, according to a second aspect of the present invention, there is provided a fallboard structure of a keyboard instrument including an instrument body (101), and a keyboard section (KB) having a rear portion (KBa) and provided in the instrument body, the fallboard structure comprising a fallboard (60) capable of being selectively made in a closed state and an open state, the fallboard covering the keyboard section when it is in the closed state, and permitting the keyboard section to be operated for performance when it is in the open state, a front plate (65) having at least one first pivot shaft (63) and having a width that is at least equal to that of the keyboard section, the front plate being capable of being selectively made in at least first and second states of posture, the front plate supporting the fallboard so as to be pivotable around the first pivot shaft in opening and closing directions, the front plate having an end portion which is positioned on a lower side and shielding a space upward of the rear portion of the keyboard section against a player when it is in the first state, the first pivot shaft being located at the end portion that is on the lower side when the front plate is in the first state, and a pair of left and right pivotably holding members (42) each having a second pivot shaft (67) and provided in the instrument body, the pivotably holding members supporting the front plate so as to be pivotable around the second pivot shafts, the second pivot shafts being located upward of the first pivot shaft when the front plate is in the first state, wherein when the fallboard is made in the open state and the front plate is caused to rotate around the second pivot shafts, the front plate is caused to be pivoted together with the fallboard so that the front plate is changed over from the first state of posture to the second state of posture, whereby the space upward of the rear portion of the keyboard section is made open toward the player.

With this construction, at the time of a musical performance, the inside of the instrument can selectively be made shielded against the player or open toward the player.

To attain the first object, according to a third aspect of the present invention, there is provided a fallboard structure of a keyboard instrument including an instrument body (101), a keybed (21) having side portions and provided in the instrument body, and a keyboard section(KB) having a rear portion (KBa) and provided in the instrument body, the fallboard structure comprising a pair of left and right supporting portions (23, 22) fixed to the keybed of the instrument body and respectively located at the side portions of the keybed, a fallboard (60) capable of being selectively made in a closed state and an open state, the fallboard covering the keyboard section when it is in the closed state and permitting the keyboard section to be operated for performance when it is in the open state, a front plate (65) having side portions and at least one first pivot shaft (63) and having a width thereof at least equal to that of the keyboard section, and being capable of being selectively made in at least first and second states of posture, the front plate holding the fallboard so as to be pivotable around the first pivot shaft in opening and closing directions, the front plate having an end portion that is located on a lower side, and shielding a space upward of the rear portion of the keyboard section against a player when it is in the first state, the first pivot shaft being located at the end portion that is positioned on the lower side when the front plate is in the first state, a pair of left and right pivotably holding members (42) each having a second pivot shaft (67) and provided in the supporting portion, the pivotably holding members holding the front plate so as to be pivotable around the second pivot shafts, the second pivot shafts being located upward of the first pivot shaft when the front plate is in the first state, a pair of left and right engaging portions provided at the side portions of the front plate, and a pair of left and right displacement guides (45) provided inside of respective ones of the supporting portions so as to correspond to the engaging portions and each having an arc portion (45*a*) thereof extending around the second pivot shaft, wherein when the fallboard is made in the open state and the front plate is caused to be pivoted around the second pivot shafts, the engaging portions are moved along the displacement guides and the front plate is moved together with the fallboard so that the front plate is changed over from the first state of posture to the second state of posture, whereby the space upward of the rear portion of the keyboard section is made open toward the player.

With this construction, at the time of a musical performance, the inside of the instrument can selectively made shielded against the player or open toward the player.

Preferably, the fallboard structure further comprises at least one retainer (45*b*, 46) for maintaining the front plate in the second state.

With this construction, it is possible to maintain a state where the space upward of the rear portion of the keyboard section is open toward the player.

Preferably, the fallboard structure further comprises at least one electronic instrument's functional element (11, 12, 13) disposed in the space upward of the rear portion of the keyboard section which is open toward the player when the front plate is in the second state.

With this construction, when one or more operators for musical tone control, for example, are provided in that part which is made open toward the player, electronic instrument-oriented musical performance can be made in the second state, and when a sound generating section such as speakers is provided, the efficiency of sound generation can be improved.

Preferably, the fallboard and the front plate are in a folded state where they face each other when the fallboard is in the open state, and when the fallboard is in the open state and the front plate is in the second state, the fallboard and the front plate can be accommodated into the instrument body by causing them to slidingly move in a rearward direction.

With this construction, musical performance can be made in a condition that the fallboard and the front plate are accommodated and are not an obstacle to the eye, and a satisfactory external appearance can be provided. At the time of making a musical performance, the fallboard can be accommodated so as not to interfere with a space upward and rearward of the keyboard section, thereby ensuring a component part installation space in the space upward and rearward of the keyboard section.

To attain the second object, according to a fourth aspect of the present invention, there is provided a fallboard structure of a keyboard instrument including an instrument body (101), a keybed (21) having side portions and provided in the instrument body, and a keyboard section (KB) having a rear portion (KBa) and provided in the instrument body, the fallboard structure comprising a pair of left and right supporting portions (23, 22) fixed to the keybed of the instrument body and located at the side portions of the keybed, a fallboard (60) capable of being selectively made in a closed state and an open state, a fallboard holder (65) having at least one first pivot shaft (63) and holding the fallboard so as to be pivotable around the first pivot shaft in opening and closing directions, and a pair of left and right movable holder members (42) each having a second pivot shaft (67) and disposed for slide motion relative to the supporting portion in a longitudinal direction of keys, the movable holder members being for making the fallboard holder pivotable around the second pivot shafts and for selectively holding the fallboard holder in at least first and second states, the fallboard holder being flipped up from the first state when it is made in the second state, wherein when the fallboard holder is in the first state and the fallboard is in the closed state, the keyboard section is covered by the fallboard, when the fallboard is in the open state, the keyboard section can be made operative for performance, when the fallboard holder is in the first state and the fallboard is in the open state, the fallboard and the fallboard holder are made in a flip-up state by causing the fallboard holder to be pivoted together with the fallboard around the second pivot shafts to bring the fallboard holder in the second state, and the fallboard and the fallboard holder are made accommodated in the instrument body by causing the movable holder members to slidingly move in a rearward direction while maintaining the fallboard and the fallboard holder in the flip-up state.

With this construction, the fallboard can be accommodated in the instrument body so as not to interfere with a space upward and rearward of the keyboard section, thereby ensuring a component part installation space in the space upward and rearward of the keyboard section.

Preferably, when the fallboard holder is in the first state, a space upward of the rear portion of the keyboard section is shielded against a player by the fallboard holder, whereas the space upward of the rear portion of the keyboard section is open toward the player when the fallboard holder is in the second state.

With this construction, at the time of performing a musical performance, the inside of the instrument can selectively made shielded against the player or open toward the player.

Preferably, the instrument body is provided with a pair of left and right displacement guides (45) for guiding a pivotal motion of the fallboard holder around the second pivot shafts.

With this construction, the pivotal motion of the fallboard holder can be made stable.

Preferably, the fallboard holder has a width thereof at least equal to that of the keyboard section and has side portions thereof provided with a pair of left and right engaging portions (69), and the displacement guides are provided so as to correspond to respective ones of the engaging portions and each have an arc portion (45*a*) centered on the second pivot shaft, and when the fallboard holder is not in the second state, the movable holder member is prevented from slidingly moving in a rearward direction due to engagement between the arc portion of the displacement guide and the engaging portion.

With this construction, upon operation of flipping up the fallboard and the fallboard holder, their rearward motion is restricted and hence the flipping-up operation can be carried out with stability.

Preferably, each of the displacement guides is provided with a retainer (45*b*, 46) for maintaining the fallboard and the fallboard holder in the flip-up state.

With this construction, a state where a space upward of the rear portion of the keyboard section is made open toward the player can be maintained.

Preferably, the retainer is a longitudinal motion guide portion (45*b*) of each of the displacement guides, which is provided in a front-to-rear direction so as to be formed continuously with the arc portion and configured to maintain the fallboard and the fallboard holder in the flip-up-state when the movable holder member is in a slide motion process.

With this construction, the flip-up operation and the sliding motion of the fallboard and the fallboard holder can smoothly and continuously be carried out, resulting in improved operability at the time of the fallboard opening and fallboard accommodation.

Preferably, when the fallboard holder is in the first state, the second pivot shafts are located upward of the first pivot shaft, and rotational moment around the second pivot shafts generated due to application of weight of the fallboard via the first pivot shaft to the fallboard holder when the fallboard holder is in the first state is exerted in a direction for resisting changeover of the fallboard holder from the first state to the second state.

With this construction, at the time of fallboard opening, the fallboard holder can be suppressed from being pivoted in the direction of establishing the second state with the progress of fallboard opening, whereby only the fallboard can smoothly be opened.

To attain the third object, according to a fifth aspect of the present invention, there is provided a keyboard instrument comprising a keyboard section (KB) comprised of a plurality of keys and having a rear portion (KBa), an opening/closing fallboard (UNT) capable of opening and closing the keyboard section and of opening and closing a space upward of the rear portion of the keyboard section relative to a player, the opening/closing fallboard capable of selectively assuming a first state where only the keyboard section is made in an open state to thereby permit the keyboard section to be operated for performance and a second state where both the keyboard section and the space upward of the rear portion of the keyboard section are made in an open state thereby permitting the keyboard section to be operated for performance, a cover member (70, 80) having a semi light-transparent portion (73, 81*a*) and located at a location that is visible through a gap between the opening/closing fallboard placed in the first state and the keyboard section, the cover member being disposed so as to cover the rear portion of the keyboard section, and a plurality of optical display sections (72, 82) disposed inside the cover member so as to correspond to respective ones of the plurality of keys of the keyboard section, light being visible through the semi light-transparent portion from the player only when any one of the optical display sections emits light having not less than predetermined brightness.

With this construction, at the time of a musical performance, it is possible to selectively carry out a performance in which the presence of light emission function is not conscious and a performance in which light emission is made visible, and the inside of the instrument can selectively be made shielded against the player or open toward the player.

Preferably, the cover member is comprised of a cover body (71) and the semi light-transparent portion, and the semi light-transparent portion is comprised of a sheet member (73) having a semi-light transparency and disposed to face the optical display sections in the cover body.

With this construction, fabrication is made easy.

Preferably, a keyboard instrument further comprises at least one electronic instrument's functional element (11, 12, 13) disposed in the space upward of the rear portion of the keyboard section which is open toward the player when the opening/closing fallboard is in the second state.

With this construction, when operators for musical tone control, for example, are provided in the space which is made open toward the player, electronic instrument-oriented musical performance can be made in the second state, and when a sound generating section such as speakers is provided, the efficiency of sound generation can be improved.

To attain the first object, according to a first aspect of the present invention, there is provided a fallboard structure of a keyboard instrument including an instrument body (101), a keybed (21) having side portions and provided in the instrument body, and a keyboard section (KB) having a rear portion (KBa) and provided in the instrument body, the fallboard structure comprising a pair of left and right supporting portions (23, 22) fixed to the keybed of the instrument body and respectively disposed at the side portions of the keybed, a fallboard (60) capable of being selectively made in a closed state and an open state, the fallboard covering the keyboard section when it is in the closed state and permitting the keyboard section to be operated for performance when it is in the open state, and a front plate (65) having side portions and at least one pivot shaft (63) and having a width thereof at least equal to that of the keyboard section, the front plate being capable of having at least first and second states of posture, the front plate supporting the fallboard so as to be pivotable around the pivot shaft in opening and closing directions and shielding a space upward of the rear portion of the keyboard section against a player when it is in the first state of posture, wherein when the fallboard is made in the open state and the front plate is caused to move, the front plate is moved in unison with the fallboard and changed over from the first state of posture to the second state of posture, whereby the space upward of the rear portion of the keyboard section is made open toward the player.

With this construction, at the time of a musical performance, the inside of the instrument can be selectively made shielded against the player or open toward the player.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail below with reference to the drawings showing preferred embodiments thereof.

Figure 1:
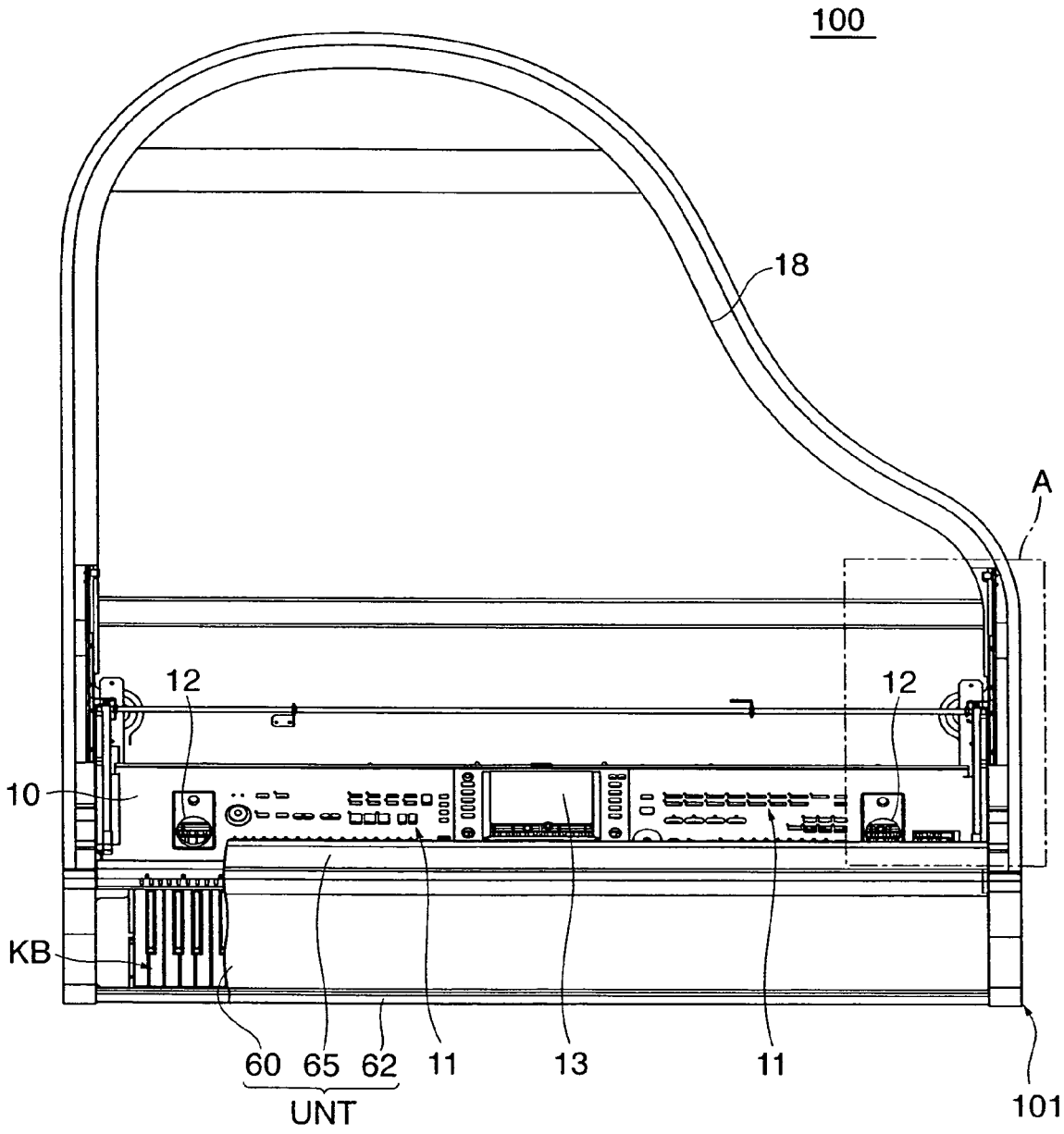
FIG. 1 is a plan view of a keyboard instrument to which a fallboard structure according to one embodiment of the present invention is applied.

FIG. 1 is a plan view of a keyboard instrument to which a fallboard structure according to one embodiment of the present invention is applied. The keyboard instrument 100 is configured as an electronic keyboard instrument, which includes an instrument body 101 supported by leg portions, not shown. In the following, the left and right directions of the instrument body 101 are those determined in reference to the player, and the side of the instrument body 101 toward a player will be referred to as the front side with regard to the front-to-rear direction.

Figure 2:
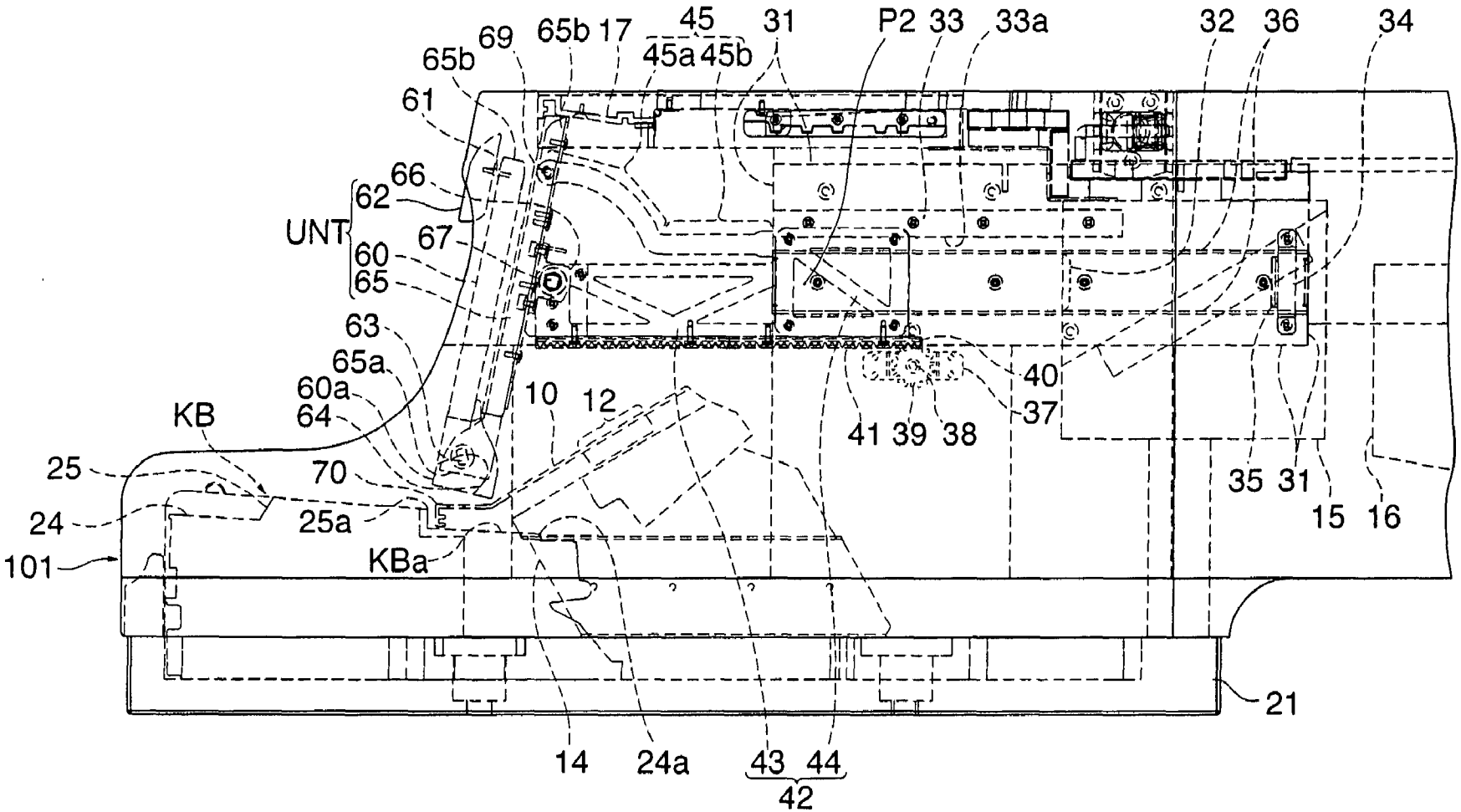
FIG. 2 is a right side view showing the inside of a body of the keyboard instrument.
Figure 3:
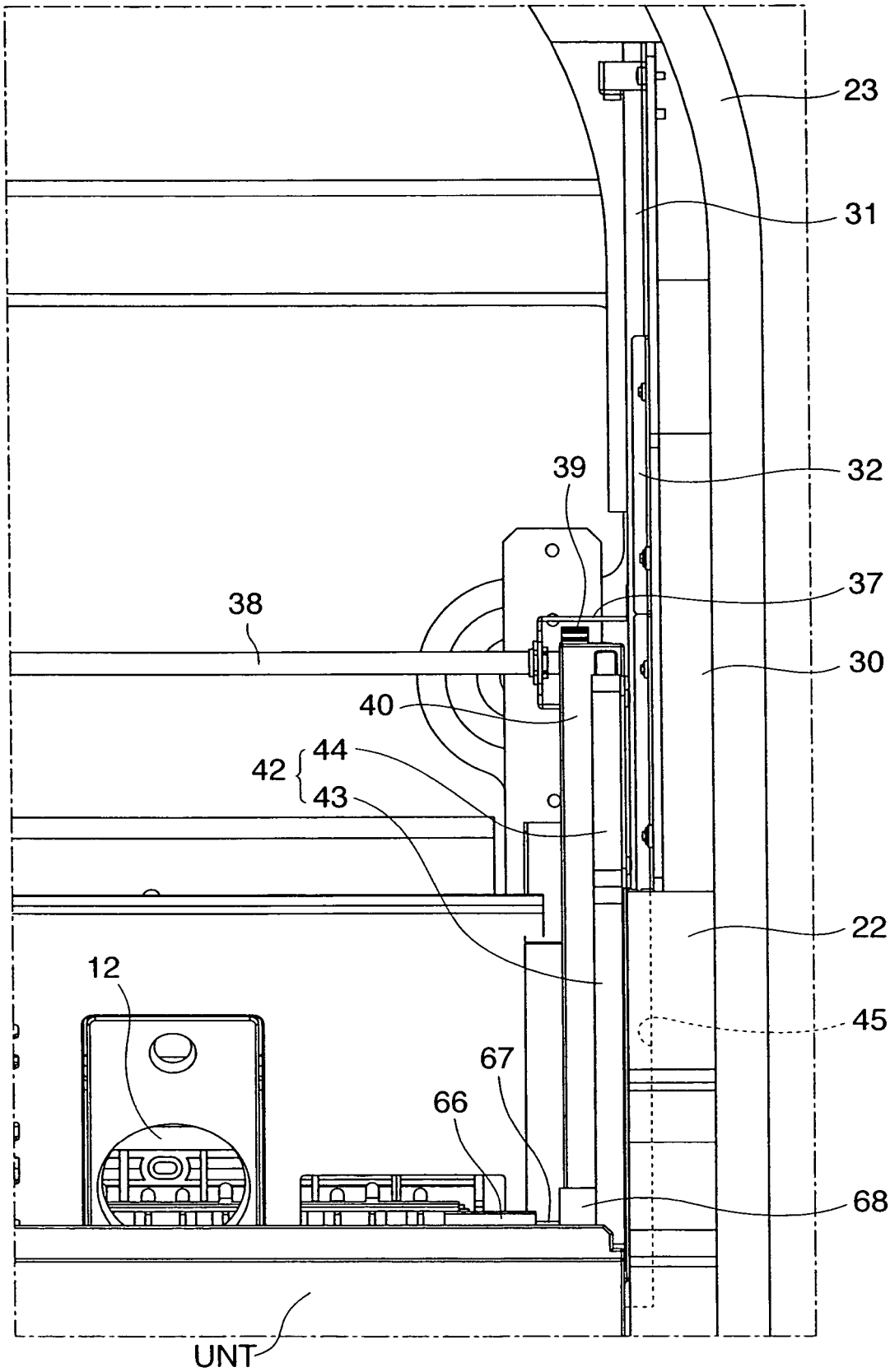
FIG. 3 is an enlarged view showing an A portion in FIG. 1.
Figure 4:
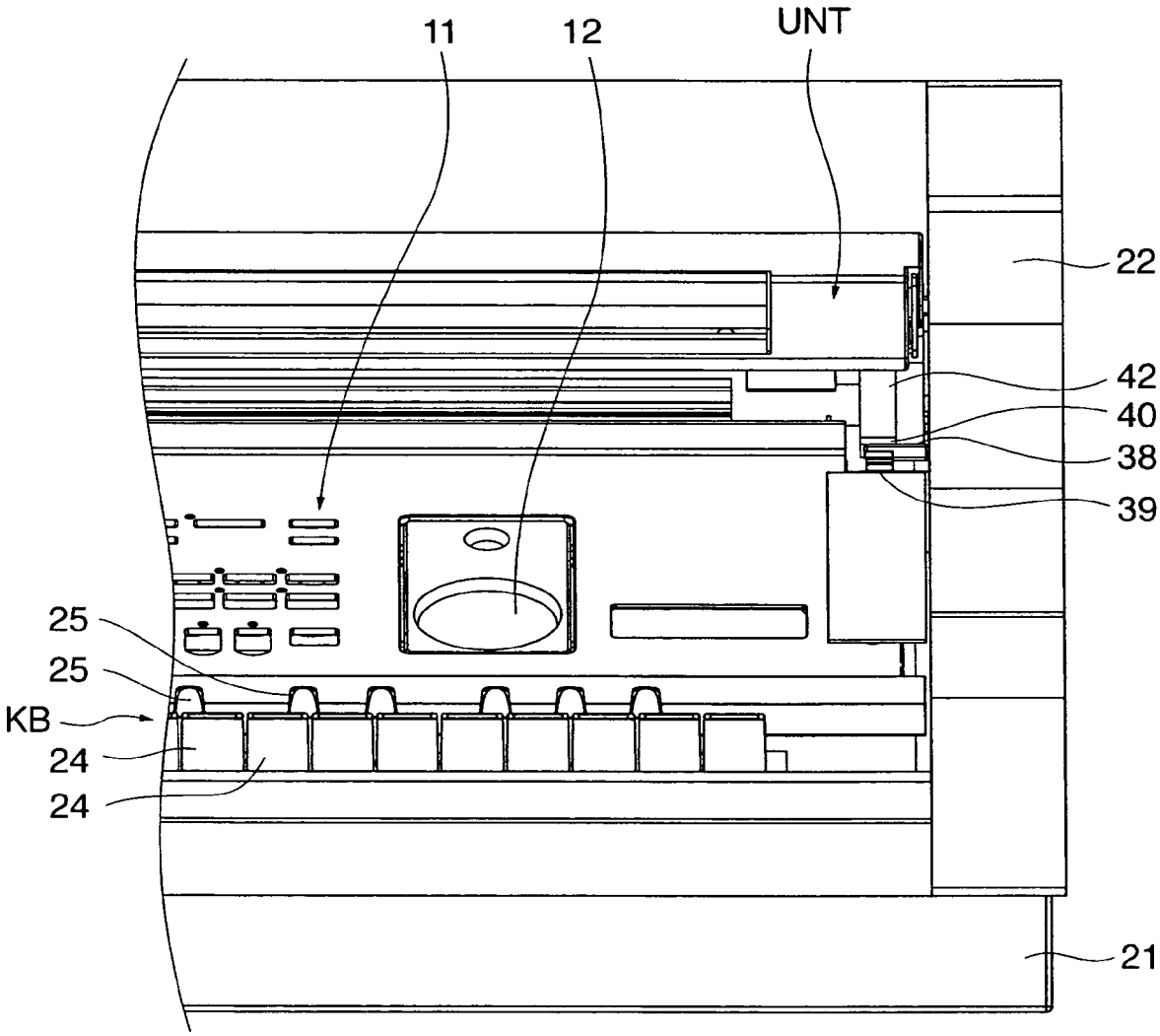
FIG. 4 is a fragmentary front view showing a right side part of the instrument body.
Figure 5:
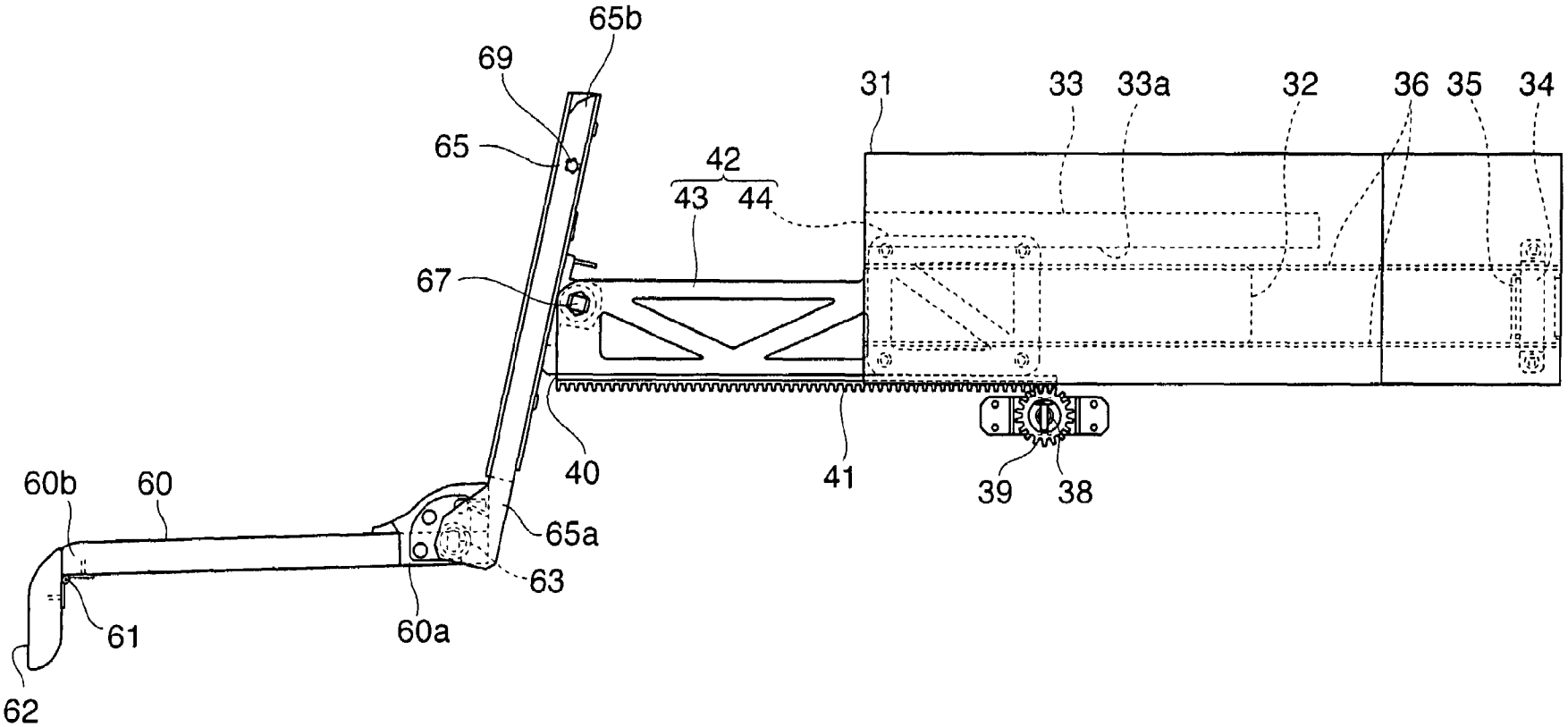
FIG. 5 is a right side view of the fallboard structure.

FIG. 2 is a right side view showing the inside of the body 101 of the keyboard instrument 100, and FIG. 3 is an enlarged view showing an A portion in FIG. 1. FIG. 4 is a fragmentary front view showing a right side part of the instrument body 101. FIG. 5 is a right side view showing a fallboard structure.

As shown in FIG. 2, the instrument body 101 is provided with an opening/closing fallboard unit (opening/closing fallboard) UNT. As will be described in detail later, the opening/closing fallboard unit UNT is mainly comprised of a fallboard front section 62, a fallboard 60, and a front plate (fallboard holder) 65.

FIG. 1 shows a state where a music book resting member 17 (refer to FIG. 2) and the like are detached from the keyboard instrument, and a panel section 10 (refer to FIG. 2) appears in FIG. 1. With regard to left-right symmetric elements, FIG. 2 shows those elements which are directly or indirectly attached to a side plate 23 (refer to FIG. 3), which is a right supporting portion disposed on the right side of the instrument. In the following description of the fallboard structure, with regard to right-left symmetric structural elements, right-side structural elements will be explained by way of example and denoted by reference numerals that are commonly applied to left-side structural elements that are the same in construction as the right-side elements.

In FIGS. 1, 3, and 5, the opening/closing fallboard unit UNT is shown in a fully closed state, whereas it is shown in a fully open state in FIG. 4. FIG. 2 shows a state where the fallboard 60 is open and the front plate 65 is closed.

Roughly speaking, the opening/closing fallboard unit UNT is capable of assuming four-step postures (states) in the course of an opening/closing operation process. In the following, a state where the opening/closing fallboard unit UNT is fully closed (refer to FIGS. 1, 3, and 5) will be referred to as the "fully-closed state," a state where the fallboard 60 is open and the front plate 65 is closed (refer to FIGS. 2 and 6) will be referred to as the "half-open state (first state)," and a state where the opening/closing fallboard unit UNT is fully open (refer to FIGS. 4 and 7) will be refer to as the "fully open state (second state)." In addition, there is an "accommodation completion state" where the opening/closing fallboard unit UNT is completely received in the instrument body 101 while retained in the fully open state (described later with reference to FIG. 8).

As shown in FIGS. 2 and 4, a keybed 21 is disposed at a bottom portion of the instrument body 101 over the entire length of the instrument body 101. On both the left and right sides of the instrument body 101, a pair of left and right side plates 23 are fixed to the keybed 21 (refer to FIG. 3), a cross arm 22 serving as a supporting portion is fixed to the inner side of a front portion of the keybed 21 (refer to FIGS. 3 and 4). As shown in FIGS. 2 and 4, a keyboard section KB comprised of a plurality of white keys 24 and a plurality of black keys 25 is disposed on an upper part of the front portion of the keybed 21.

As shown in. FIG. 2, at a location rearward of the keyboard section KB, a panel section 10 is mounted to the keybed 21 through a panel mounting portion 14. The panel section 10 obliquely extends upward toward the rear side thereof. On a front surface of the panel section 10, there are disposed electronic instrument's functional elements such as a pair of left and right speakers 12 for electrically generating sounds, a group of operators 11 for instrument setting, musical tone control, and the like, and a display section 13 for information display (refer to FIG. 1). In the rear half of the instrument body 101, sound generating sections 15, 16 including speaker boxes are disposed rearward of the panel section 10. A large roof 18 can be opened (refer to FIG. 1) so as to emit sounds from the speakers 12 and the sound generating sections 15, 16. As will be described later, sounds from the speakers 12 can also be emitted toward the player (toward frontward), with the opening/closing fallboard unit UNT being in the fully open state.

First, an explanation will be given of the opening/closing fallboard unit UNT. In considering a change in posture of the opening/closing fallboard unit UNT, the rear end and front end of the fallboard 60 when the unit is in the fully closed state shown in FIG. 5 will be referred to as the first end portion 60*a* and the second end portion 60*b*, respectively. In this fully closed state, the lower and upper ends of the front plate 65 will be referred to as the first end portion 65*a* and the second end portion 65*b*, respectively.

As shown in FIGS. 2 and 5, the fallboard front section 62 is supported at the second end portion 60*b* of the fallboard 60 so as to be pivotable around a pair of left and right pivot shafts 61. The fallboard front section 62 can assume a state extending nearly perpendicular to the fallboard 60 (refer to FIG. 5) or a state facing the fallboard 60 (refer to FIG. 2). The fallboard front section 62, the fallboard 60, and the front plate 65 are provided between the left and right cross arms 22. Each of them 60, 62, 65 is slightly larger than the keyboard section KB in width in the left-to-right direction. When the opening/closing fallboard unit UNT is in the fully closed state, the fallboard front section 62 covers the front part of the keyboard section KB.

The fallboard 60 has a first end portion 60*a* thereof supported at the first end portion 65*a* of the front plate 65 so as to be pivotable around the pivot shafts (pivot shaft, first pivot shaft) 63. The fallboard 60 and the front plate 65 have their surfaces made of wood similar to that used for acoustic grand piano (hereinafter simply referred to as the "acoustic piano") and are similar in external appearance to the acoustic piano. The first end portion 60*a* of the fallboard 60 and the first end portion 65*a* of the front plate 65 each have left and right side surfaces thereof forming part of a pivotal motion mechanism and are each made of a metal member.

The fallboard 60 is provided at the first end portion 60*a* with a torque damper unit, not shown. The pivot shaft 63 for the fallboard projects from the torque damper unit, and is fitted into a hole formed in the first end portion 65*a* of the front plate 65. The torque damper unit is of a one-way type, which does not generate a torque when the fallboard 60 is pivoted in the fallboard opening direction (clockwise direction in FIG. 2), and generates a torque only when the fallboard 60 is pivoted in the closing direction (counterclockwise). As a result, the fallboard 60 can be opened with a small force, whereas the fallboard 60 can be moderately closed with its own weight.

On the rear surface of the front plate 65, a pair of left and right torque damper units 66 are provided at locations slightly closer to the second end portion 65*b* than to an intermediate position between the first and second end portions 65*a*, 65*b* (refer to FIGS. 2 and 3). At least a rear surface portion of the front plate 65 in which the torque damper unit 66 is provided is made of a metal member. A pair of left and right slide arms (pivotably holding member, movable holder member) 42, described later, each have a front arm 43 provided with a damper shaft retainer 68 (refer to FIG. 3). A pivot shaft (second pivot shaft) 67 for the front plate, which is a damper shaft projecting from a corresponding one of the torque damper units 66, is fitted into a hole formed in the damper shaft retainer 68, whereby the front plate 65 is supported by the slide arms 42 so as to be pivotable around the pivot shaft 67. The torque damper unit 66 is also of a one-way torque type which generates a predetermined torque only when the front plate 65 is pivoted in the closing direction (counterclockwise in FIG. 2). As a result, the front plate 65 can be opened with a small force, and can be quietly closed with its own weight at the time of fallboard closing operation.

In the pivot mechanism for the fallboard 60, the damper mechanism for generating a torque may be provided in the fallboard 60 or the front plate 65. Also in the pivot mechanism for the front plate 65, the damper mechanism may be provided in the front plate 65 or the slide arm 42. As shown in FIG. 2, the second end portion 65*b* of the front plate 65 has left and right side surfaces thereof provided with engaging pins (engaging portions) 69 so as to project outward in the left and right direction, respectively. The first end portion 60*a* of the fallboard 60 is provided with a handy-grip recess 64 which is formed in the first end portion 60*a* at a location inside the pivot mechanism. The handy-grip recess 64 is a part on which the player or the like places the hand when the opening/closing fallboard unit UNT is changed over from the half-open state to the fully open state. The handy-grip recess 64 may be formed in the keyboard section KB over the entire length thereof or only at predetermined left and right parts of the first end portion 60*a*.

When the opening/closing fallboard unit UNT is in the fully closed state, the keyboard section KB is covered by the fallboard 60. In the half-open state or the fully open state, the keyboard section KB is made open so that an operation for performance may be carried out. Thus, the operation for performance can be carried out not only when the fallboard 60 and the front plate 65 are in the open state, but also when only the fallboard 60 is open, with the front plate 65 closed.

The front plate 65 in the closed state shields a space upward of the rear portion KBa of the keyboard section KB against the player, whereas it causes the space upward of the rear portion KBa open toward the player when it is in the open state. When the space upward of the rear portion KBa is open, the panel section 10 is made visible from the player and becomes operable. In particular, sounds from the speakers 12 are emitted forwardly from the open space upward of the rear portion KBa, whereby sounds can be efficiently emitted.

As shown in FIGS. 2 and 5, the slide arm 42 is comprised of a front arm 43, a rear arm 44, and a rack member 40. The front arm 43 and the rear arm 44 are made of metal and formed into one piece. Alternatively, they may be fabricated separately, and then may be fixed together. The rack member 40 is fixed to a lower surface of the slide arm 42 so as to extend from the front arm 43 to the rear arm 44. The lower surface of the rack member 40 is formed with a rack gear 41 over the entire length thereof.

As shown in FIG. 3, a guide mounting member 30 is fixed to an inner side surface of the side plate 23 on the side rearward of the cross arm 22. The guide mounting member 30 is mounted with a slide guide body 31 (also refer to FIGS. 2 and 5). As shown in FIGS. 2 and 5, the slide guide body 31 is provided with a pair of upper and lower guide rails 36 extending parallel to each other along the front-to-rear direction. An intermediate guide member 32 is slidably engaged with the guide rail 36 through a number of cylindrical bearings, not shown. In the present embodiment, an assembly having the intermediate guide member 32 assembled to the slide guide body 31 is used, which is commercially available (for example, linear slide 4045F manufactured by THK corporation).

The rear arm 44 of the slide arm 42 is slidably engaged with the intermediate guide member 32. In a process in which the slide arm 42 is slidingly moved in the front-to-rear direction, the intermediate guide member 32 is slid over a distance half the distance for which the slide arm 42 is slid, whereby the slide arm 42 can smoothly be slid relative to the slide guide body 31.

As shown in FIGS. 2 and 5, a stopper member 34 is mounted to a rear portion of the slide guide body 31, and a buffering member 35 is mounted to a front portion of the stopper member 34. When a rear end of the rear arm 44 is in contact with the buffering member 35, the position of the rear end of the slide arm 42 is restricted in the sliding process (refer to FIG. 8). There is also provided a stopper member, not shown, that restricts the position of the front end of the slide arm 42 in the sliding process. FIGS. 2 and 5 show a state where the slide arm 42 is in the front end position. On the left side of the instrument body 101, the slide arm 42 and the relevant elements are provided in symmetry with those provided on the right side of the instrument body 101.

Further, as shown in FIGS. 2, 3 and 5, an interlocking rod retainer 37 is fixed to the side plate 23, and an interlocking rod 38 is rotatably held at an end portion thereof by the interlocking rod retainer 37. A pinion gear 39 in mesh with the rack gear 41 of the rack member 40 is rotatably mounted to the end portion of the interlocking rod 38. The same mechanism is provided on the left side plate in symmetry with that on the right side. Thus, the left and right pinion gears 39 rotate in unison with the interlocking rod 38. When the slide arm 42 is slid in the front-to-rear direction while being guided by the guide rail 36, the left and right slide arms 42 are moved by always the same amount of movement due to the mesh of the left and right pinion gears 39 and the corresponding rack gears 41. As a result, the slide arm 42 is prevented from rolling and bumpy in the horizontal direction, and makes a smooth sliding motion in the front-to-rear direction, while always stable in posture.

As shown in FIGS. 2 and 3, the cross arm 22 is provided on its inner side with a guide groove (displacement guide) 45. The guide groove 45 is provided by fixing a separate member, which is made of metal or the like and formed with a groove, to the cross arm 22. Alternatively, the guide groove may be directly formed in the cross arm 22. As shown in FIG. 2, the guide groove 45 is comprised of an arc portion 45*a* and a straight portion (retainer or longitudinal motion guide portion) 45*b* that are formed continuously. The arc portion 45*a* is formed along a circle centered on the pivot shaft 67, whereas the straight portion 45*b* is formed along the front-to-rear direction. Furthermore, as shown in FIGS. 2 and 5, a guide member 33 extending continuously with the straight portion 45*b* of the guide groove 45 is fixed to the inner side of the keybed 21. On the left side of the instrument body 101, there are also provided a guide groove 45 and a guide member 33 in symmetry with those formed on the right side of the instrument body 101.

An engaging pin 69 of the front plate 65 is in sliding engagement with the guide groove 45. When the front plate 65 is in the closed state, the engaging pin 69 is in engagement with a front end of the arc portion 45*a* (refer to FIG. 2). When the front plate 65 rotates around the pivot shaft 67, the left and right engaging pins 69 are each guided along the arc portion 45*a* of the guide groove 45, whereby the front plate 65 is pivoted with stability. When the front plate 65 is made in the open state, the engaging pin 69 is positioned at a connection between the arc portion 45 and the straight portion 45*b*.

The straight portion 45*b* of the guide groove 45 has an upper surface thereof brought in engagement with the engaging pin 69 as the slide arm 42 is slidingly moved, to prevent the front plate 65 from pivoting in the closing direction, thus maintaining the front plate 65 in the open state. The lower surface 33*a* of the guide member 33 is also in engagement with the engaging pin 69, achieving a similar function. The vertical position of the lower surface 33*a* of the guide member 33 is approximately the same as that of the upper surface of the straight portion 45*b*. As a result, when the slide arm 42 is slidingly moved, the engaging pin 69 is smoothly delivered between the straight portion 45*b* and the lower surface 33*a* of the guide member 33.

The keyboard instrument 100 is configured to have an external appearance quite similar to that of the acoustic piano when the opening/closing fallboard unit UNT is fully closed. Even when the unit is in the half-open state, it has an external appearance similar to that of the acoustic piano whose fallboard is open. The panel section 10 located rearward of a lower half of the front plate 65 which is in the closed state is positioned at a height approximately equal to that of the lower half of the front plate 65. Thus, when the opening/closing fallboard unit UNT is made in the fully open state, the panel section 10 is exposed as viewed from the player and made operable. As a result, the instrument has an appearance proper to electronic keyboard instrument. In FIG. 2, symbol P2 designates the uppermost position of the panel section 10. When a main switch is switched on with the opening/closing fallboard unit UNT set in the half-open state, the instrument operates such that acoustic piano sounds are sounded by default, whereby an acoustic piano-like performance can be started, without the need of operating other operators. Alternatively, the instrument may be designed such that the main switch is automatically turned on simply by opening the fallboard 60, whereby performance with acoustic piano sounds can be immediately started.

Next, an explanation will be given of operations for opening/closing and accommodating the fallboard unit UNT.

Figure 6:
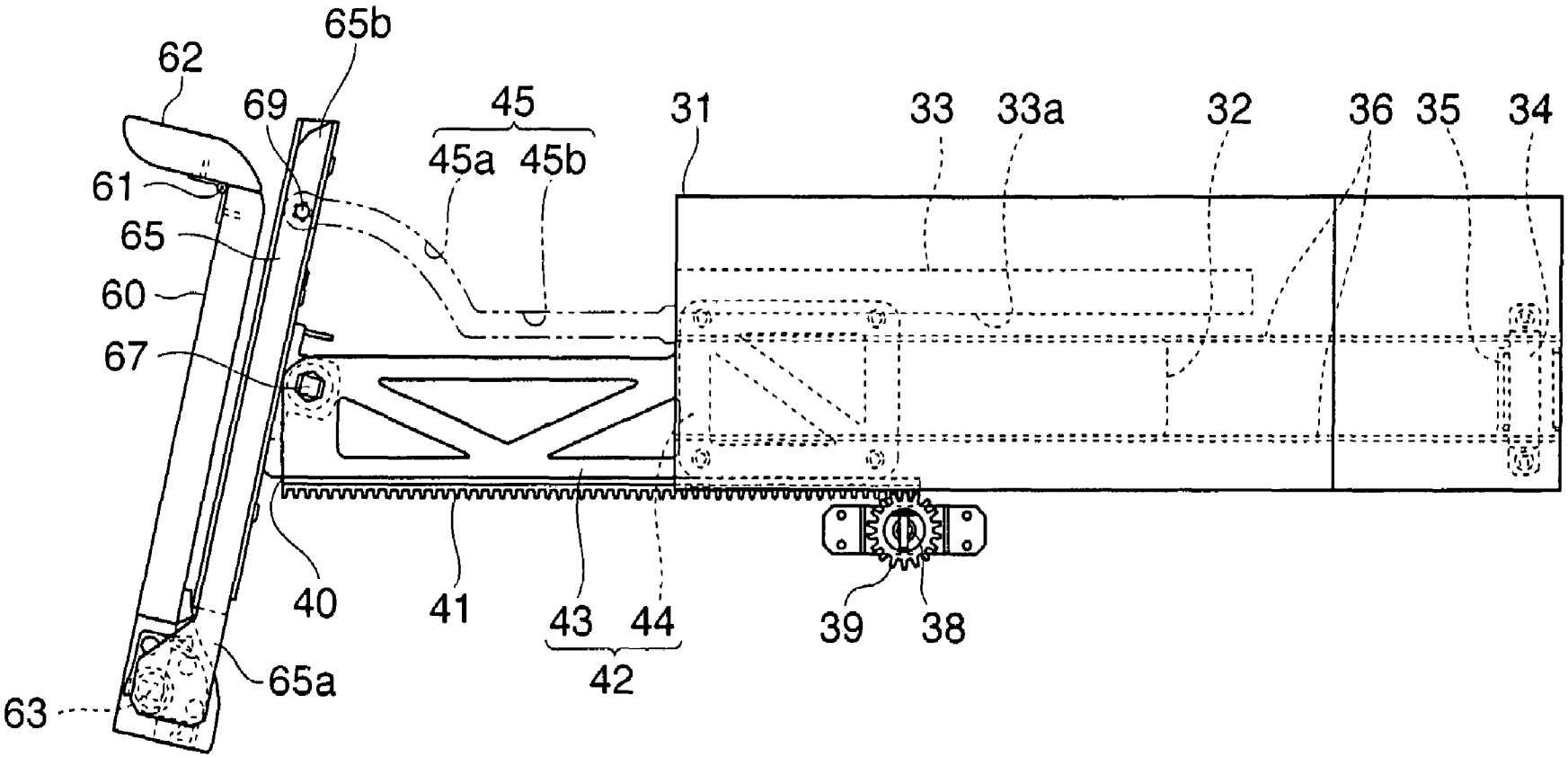
FIG. 6 is a right side view showing the fallboard structure, with an opening/closing fallboard unit being in a half-open state.
Figure 7:
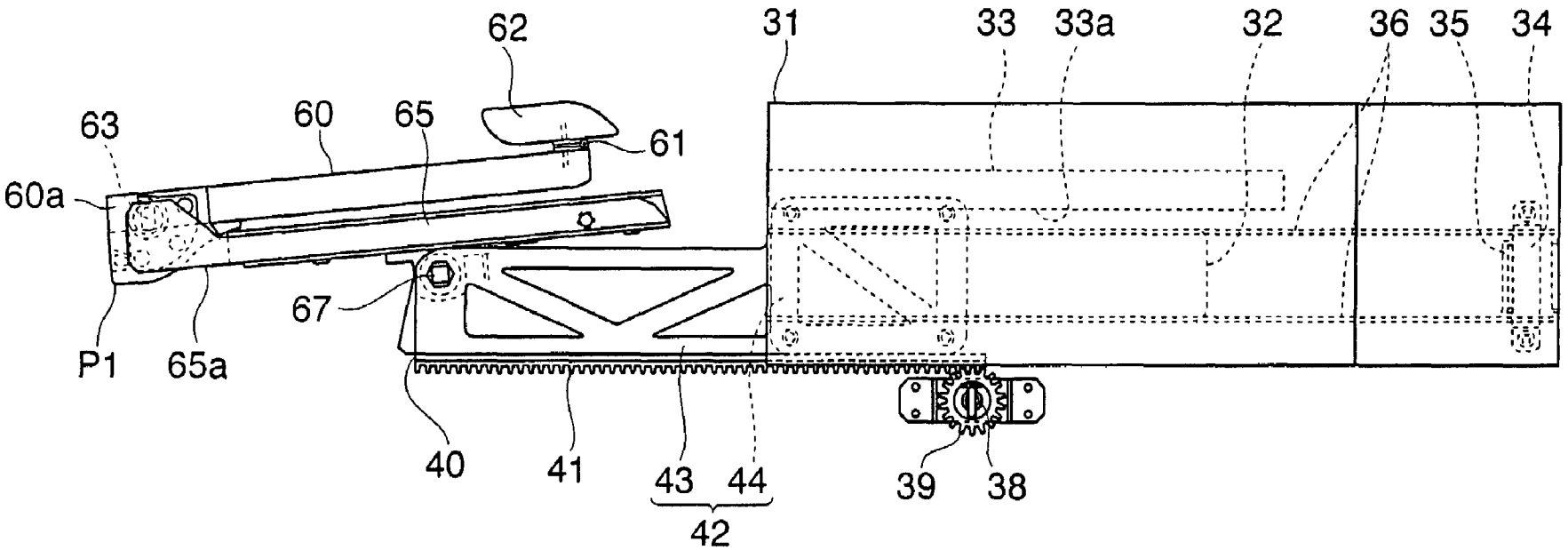
FIG. 7 is a right side view of the fallboard structure, in which the opening/closing fallboard unit set in a fully open state is being accommodated into the instrument body.
Figure 8:
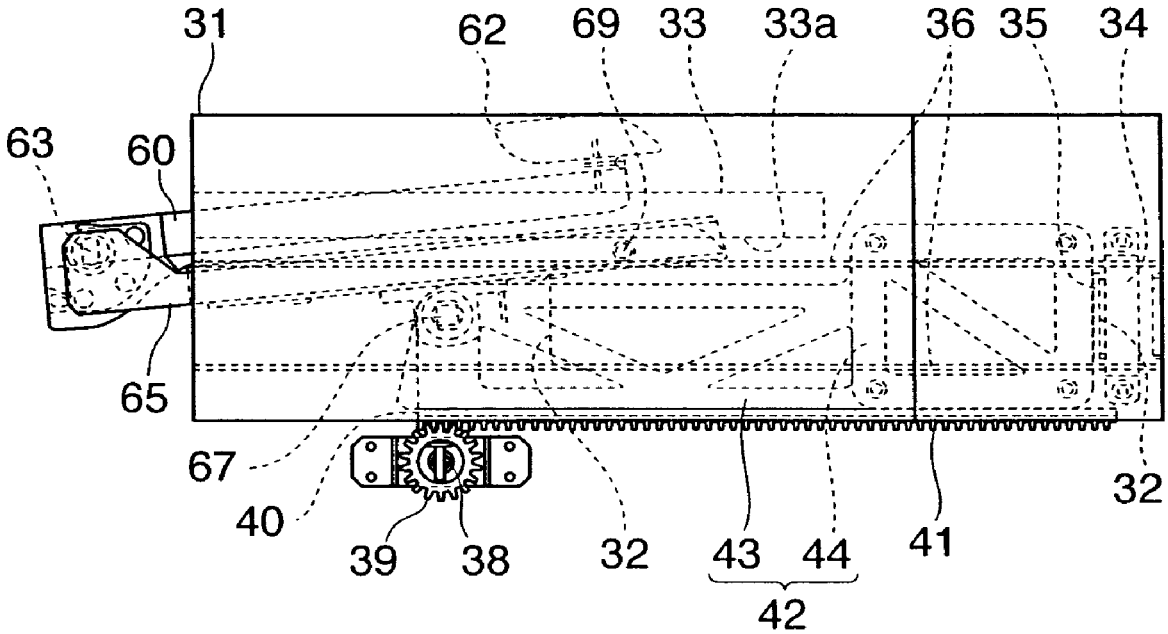
FIG. 8 is a right side view showing the fallboard structure in a state where the opening/closing fallboard unit has been accommodated into the instrument body.

FIG. 6 is a right side view showing the fallboard structure, with the opening/closing fallboard unit UNT being in the half-open state, FIG. 7 is a right side-view of the fallboard structure, in which the opening/closing fallboard unit UNT set in the fully open state is being accommodated into the instrument body 101, and FIG. 8 is a right side view showing the fallboard structure in a state where the opening/closing fallboard unit UNT has completely been accommodated into the instrument body 101.

In the fully closed state shown in FIG. 5, when the fallboard front section 62 is lifted up with a grip portion thereof, not shown, being gripped, the fallboard 60 is pivoted around the pivot shaft 63, so that the fallboard 60 is brought in a folded state where it faces the front plate 65, as shown in FIG. 6. Then, the fallboard front section 62 is further folded, whereby the half-open state shown in FIG. 2 is achieved wherein the fallboard front section 62, the fallboard 60, and the front plate 65 are folded one upon another. In this state, the keyboard section KB may be operated for performance.

In the closed state, the front plate 65 is urged, due to its own weight balance, counterclockwise in FIG. 2 around the pivot shaft 67. In addition, the front plate 65 is made coupled to the fallboard 60 and hence the weight of the fallboard 60 is applied to the first end portion 65*a*. Thus, the front plate 65 is applied with a rotational moment around the pivot shaft 67, which acts in the counterclockwise direction in FIG. 2. As a consequence, the front plate 65 is urged in the direction resisting a shift from the closed state to the open state. Therefore, when an operation of lifting up the fallboard 60 is simply performed in a general manner with the fallboard front section 62 grasped, only the fallboard 60 is pivoted, without the front plate 65 being pivoted. This permits a smooth opening operation of the fallboard 60.

When the fallboard 60 is lifted up with the handy-grip recess 64 (refer to FIG. 2) of the first end portion 60*a* of the fallboard 60 being gripped, the fallboard 60 and the front plate 65 are pivoted together around the pivot shaft 67 for the front plate. At that time, the engaging pin 69 slidingly moves along the arc portion 45*a* of the guide groove 45. As a result, the opening/closing fallboard unit UNT is brought in the fully open state as shown in FIG. 7. Specifically, the opening/closing fallboard unit UNT is brought in a "flip-up state" where it is folded and extended horizontally. In this state, the keyboard section KB may be operated for performance.

During the course of the front plate 65 being pivoted, the engaging pin 69 is in engagement with the arc portion 45*a* of the guide groove 45. Thus, by means of the arc portion 45*a*, the engaging pin 69 is restricted in motion in the front-to-rear direction. For this reason, during the pivotal motion of the front plate 65, the slide arm 42 is prevented from moving rearward, and as a result, the slide arm 42 is retained at the front end position, whereby the front plate 65 can be opened smoothly.

Immediately after the opening/closing fallboard unit UNT being flipped up, a force slightly applied on the handy-grip recess 64 ordinarily acts on the opening/closing fallboard unit UNT in the rearward direction. By virtue of such a force, there occurs a shift from engagement of the engaging pin 69 with the arc portion 45*a* of the guide groove 45 to engagement with the straight portion 45*b*. When the engaging pin 69 is in engagement with the straight portion 45*b*, the opening/closing fallboard unit UNT never be closed. Thus, it is kept maintained in the fully open state, although such state is still unstable. Even if the engaging pin 69 is not in engagement with the straight portion 45*b*, the opening/closing fallboard unit UNT is prevented from being abruptly closed, due to the presence of the torque damper unit 66.

When the opening/closing fallboard unit UNT is lightly pushed rearward, the slide arm 42 slidingly moves rearward relative to the guide rail 36 of the guide body 31 through the intermediate guide member 32. The opening/closing fallboard unit UNT also moves rearward, with the engaging pin 69 engaged with the straight portion 45*b* and the flip-up state kept unchanged. During the course of sliding motion, the engaging pin 69 is made out of engagement with the straight portion 45*b* and brought in engagement with the lower surface 33*a* of the guide member 33, however, the sliding motion is continued with the flip-up state maintained.

As described above, during the course of sliding movement, the left and right slide arms 42 smoothly make a sliding motion due to the engagement between the left and right pinion gears 39 and the rack gears 41. By causing the slide arms 42 to slide until the rear ends thereof are brought in abutment with the buffering members 35, the opening/closing fallboard units UNT and the slide arms 42 are accommodated in the instrument body 101 (refer to FIG. 8). The key board section KB can be operated for performance in any stage between the state shown in FIG. 7 and the state shown in FIG. 8.

In order to close the opening/closing fallboard unit UNT, the opening/closing fallboard unit UNT in the accommodation completion state shown in FIG. 8 is caused to slide forwardly whereby it is drawn out. Then, the unit is caused to slide up to the front end position to thereby cause the engaging pin 69 to be brought in engagement with the arc portion 45*a* of the guide groove 45, whereupon the opening/closing fallboard unit UNT is slowly pivoted due to its own weight in the closing direction, to be brought in the half-open state. Thereafter, the fallboard 60 is made closed as the fallboard front section 62 is opened, whereby the fully closed state is restored.

When the opening/closing fallboard unit UNT is in the fully open state (flip-up state), the lowermost position of the opening/closing fallboard unit UNT (i.e., the position of the first end portion 60*a* of the fallboard 60 indicated by P1 in FIG. 7) is kept higher than the uppermost position P2 of the panel section 10 (refer to FIG. 2), and is far higher than the lowermost end position of the opening/closing fallboard unit UNT in the half-open state (which is the same as the position P1 of the first end portion 60*a* of the fallboard 60 shown in FIG. 2). As a result, the opening/closing fallboard unit UNT, which moves in the front-to-rear direction with its flip-up state kept unchanged, never interferes with the panel section 10.

Figure 9:
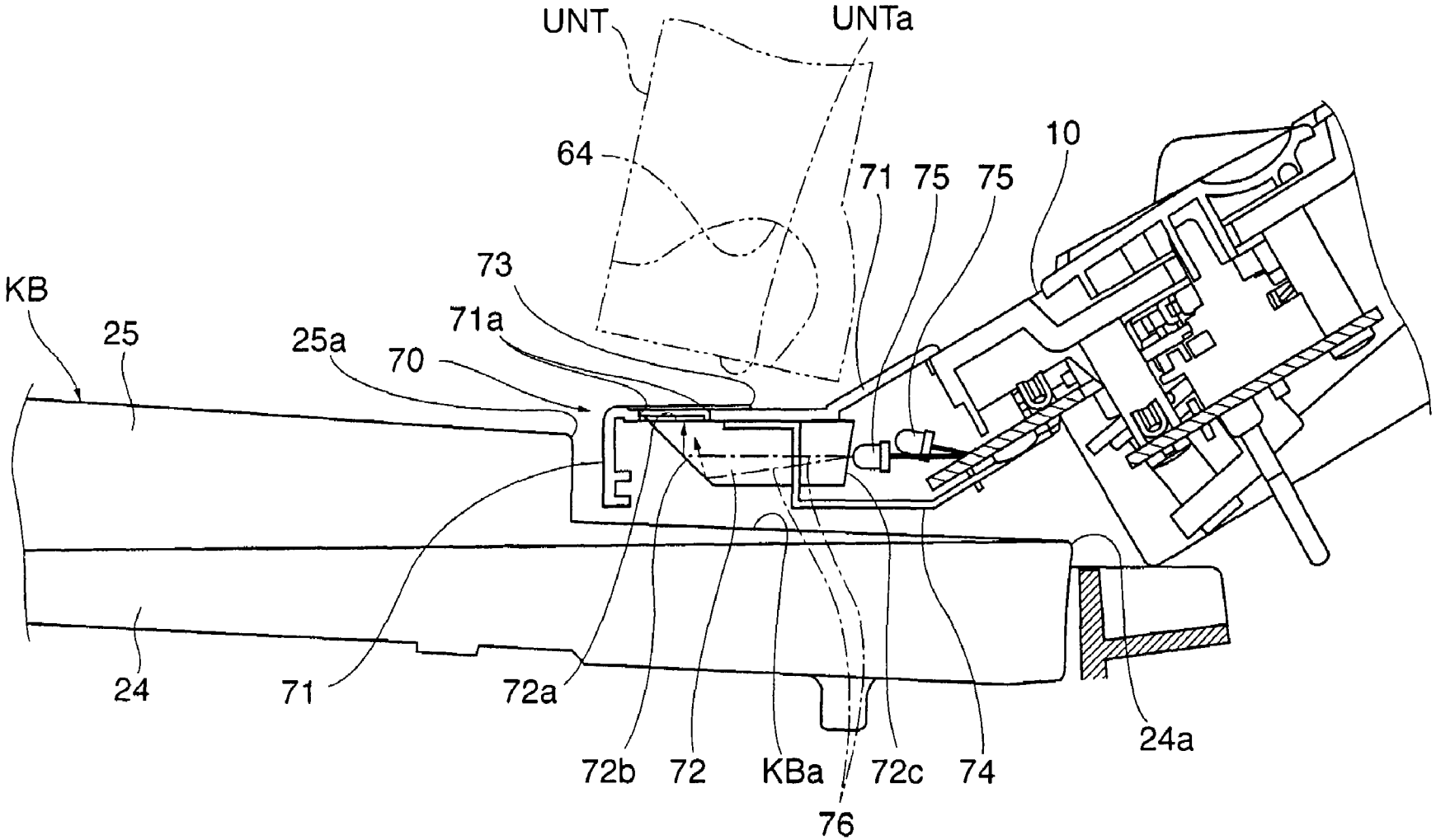
FIG. 9 is an enlarged section view showing a front part of a panel section.
Figure 10:
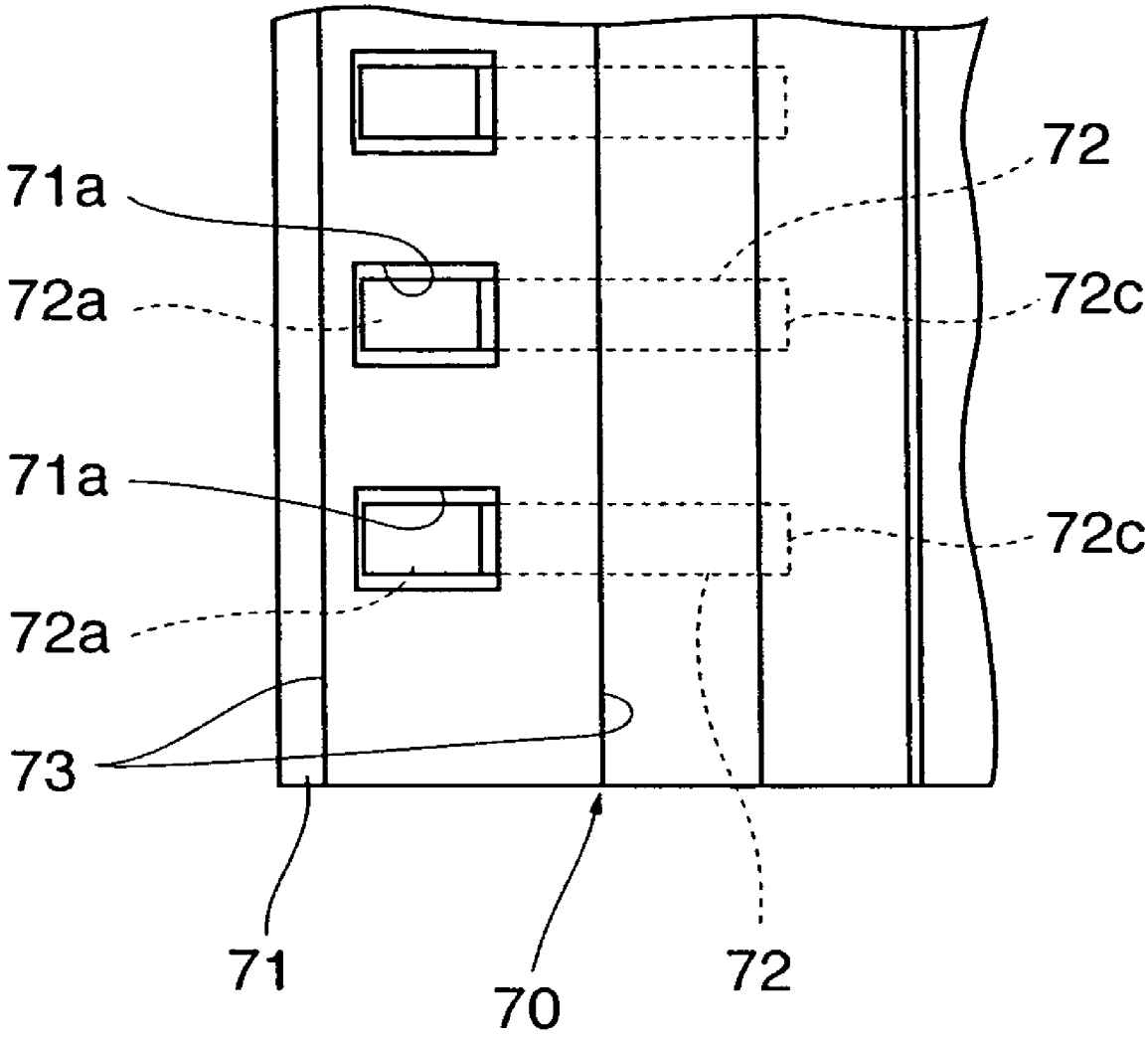
FIG. 10 is a fragmentary plan view showing a cover member.

Next, an explanation will be given of the construction of a front part of the panel section 10. FIG. 9 is an enlarged section view showing the front part of the panel section 10. The front part of the panel section 10 is provided with a cover member 70 over the width of the keyboard section KB. FIG. 10 is a fragmentary plan view showing the cover member.

As shown in FIG. 9, a supporting member 74 is fixed to a lower end portion (which is also a front part) of the panel section 10, and a cover body 71 of the cover member 70 is fixed to an upper part of a lower end portion of the panel section 10 and the supporting member 74. A front end portion of the cover body 71 is bent downward, to thereby hide rearward of the keyboard section KB. The cover member 70 is disposed right above the rear portion KBa of the keyboard section KB. Specifically, the cover member 70 is located between upper rear ends 25*a* of the black keys 25 and upper rear ends 24*a* of the white keys 24 as viewed in the front-to-rear direction. When the opening/closing fallboard unit UNT is in the fully open state, the upper surface of the cover member 70 is fully visible from the player. In the half-open state of the opening/closing fallboard unit UNT, most parts of the cover member 70 are visible through a gap between the lower end portion of the opening/closing fallboard unit UNT and the upper rear ends 25*a* of the black keys 25. In particular, since the opening/closing fallboard unit UNT is provided with the handy-grip recess 64, the cover member 70 is well visible in a range where the handy-grip recess 64 is provided.

As shown in FIGS. 9 and 10, the cover body 71 is formed at its inner side with lens members 72 made of a transparent resin or the like so as to correspond to respective ones of the white keys 24 and the black keys 25. Each of the lens members 72 has a rear end surface 72*c*, a slanted surface 72*b* directed downward and disposed at a front part, and an upper surface 72*a* located above the slanted surface 72*b* and serving as a light-emitting surface. The cover body 71 has an upper surface thereof formed with through holes 71*a* so as to correspond to respective ones of the lens members 72. The upper surface 72*a* of each lens member 72 is located within a corresponding one of the through holes 71*a*. In the cover body 71, a sheet member (semi light-transparent part) 73 is affixed to the cover body 71 over the entire width thereof so as to cover the through holes 71*a*. The upper surfaces 72*a* of the lens members 72 are disposed to close to and face the sheet member 73. In a lower end portion of the panel section 10, LEDs 75 are disposed so as to be close to the rear end surfaces 72*c* of the lens members 72 and correspond to respective ones of the lens members 72.

Each LED 75 emits light with predetermined brightness. When the LED 75 emits light, the emitted light enters the rear end surface 72*c* of the corresponding lens member 72 as shown by an arrow 76 in FIG. 9, passes through the inside the lens member 72, is reflected by the inner side of the slanted surface 72*b*, and is emitted from the upper surface 72*a*.

The sheet member 73 is made of a semi-transparent member. Specifically, the sheet member 73 is made of a material such that, when the corresponding LED 75 emits light, light passing through the sheet member 73 (light emitted from the upper surface 72*a* of the lens member 72) is visible, and when the LED 75 does not emit light, the lens member 72 and the LED 75 are hidden by the sheet member 73 and are not visible. More specifically, there may be adopted a material used as a raw material for keys, as disclosed in Japanese Patent No. 3149107. For instance, the sheet member 73 is made from a material that is comprised of a base resin having transparency, coloring pigment such as black pigment, and light diffusing agent having a light diffusing ability. The sheet member 73 is not limited in color. In consideration of the strength of light emission of the LEDs 75, the surface color, light transparency, and light diffuseness of the material from which the sheet member 73 is made are adjusted by determining the compositions of the pigment and light diffusing agent to be contained in the material so as to satisfy the aforesaid desired property of the material.

Although not illustrated, the keyboard instrument 100 is provided with key depression sensors for detecting individual operations of the white keys 24 and the black key 25, a storage section for storing automatic performance data, a tone generator circuit, a CPU for overall control of the keyboard instrument 100, etc. The LEDs 75 are used for performance practice. For example, in a manual performance mode, each LED 75 emits light when the corresponding key 24 or 25 is depressed with a force not less than predetermined strength. In the automatic performance mode, the individual LEDs 75 emit light in accordance with the automatic performance data, whereby a so-called performance assist can be provided.

The cover member 70 is always visible from the player when performance can be carried out. On the other hand, when the LEDs 75 do not emit light, the cover member 70 is solely recognized as a decoration cover or the like. Thus, the presence of the lens members 72 and the LEDs 75 never be conscious. In particular, the presence of the lens members 72 is not conscious, even if the operation for performance is implemented in a condition that the opening/closing fallboard unit UNT is in the half-open state, whereby music performance can be carried out by the keyboard instrument with an acoustic piano-like external appearance.

When the lens members 72, the LEDs 75, etc. should be used for performance assist or the like, the opening/closing fallboard unit UNT is made in the fully open state, whereby light emitted from the lens members 72 is made visible, without difficulty, from parts corresponding to the through holes 71 formed in the sheet member 73. In addition, at that time, the panel section 10 appears at that part upward of the rear portion KBa of the keyboard section KB, which is open toward the player, and the keyboard instrument can be operated for an electronic keyboard instrument-oriented performance, without any difficulties.

A detector for detecting the open and closed states of the opening/closing fallboard unit UNT may be provided, and the LEDs 75 may be prevented from emitting light without exception in the half-open state. In other words, the light emitting function of the LEDs 75 may be allowed only in the fully open state. With such arrangement, even when a mode is set in which light emission is performed in conjunction with key depression, the user is only required to set the opening/closing fallboard unit UNT in the half-open state in order to carry out operations for acoustic piano-like performance, without the need of performing operations for stopping light emission function.

According to the present embodiment, operations for performance can be carried out with an acoustic piano-like appearance by making the opening/closing fallboard unit UNT in the half-open state by simply opening the fallboard 60. By opening the front plate 65 together with the fallboard 60 to thereby make the unit in the fully open state, operations for performance can be carried out with the space upward of the rear portion KBa of the keyboard section KB kept open. Besides, since the panel section 10 having electronic instrument's functional elements is disposed on the part which is open toward the player in the fully open state and is rendered operable, not only the efficiency of sound emission from the speakers 12 (refer to FIG. 2) can be improved, but also operations for electronic instrument-oriented performance can be carried out without difficulties. In other words, at the time of musical performance, whether the inside of the instrument body 101 should be shielded against or opened toward the player can be selected, making it possible to selectively perform a musical performance with an acoustic piano-like appearance or an electronic instrument-oriented musical performance.

According to the present embodiment, by slidably moving the slide arms 42 in the rearward direction with the fallboard 60 and the front plate 65 kept in a flip-up state (refer to FIG. 2), the opening/closing fallboard unit UNT can be accommodated into the instrument body 101. At the time of conducting musical performance, it is possible to cause the opening/closing fallboard unit UNT to be accommodated in the instrument body 101 so as not interfere with the space located upward and rearward of the keyboard section KB, thus ensuring that the just-mentioned space offers a component part installation space. In this installation space which does not disadvantageously affect the opening/closing operations of the fallboard unit UNT, the panel section 10 mounted with musical instrument's functional elements can be disposed. Thus, the space-saving of the instrument body 101 can be achieved, while making it possible to selectively perform a musical performance with an acoustic piano-like appearance or an electronic instrument-oriented musical performance. In a musical performance, the opening/closing fallboard unit UNT which is accommodated does not constitute an obstacle to the eye, providing good showing.

Since the engaging portion 69 is guided by the arc portion 45*a* of the guide groove 45 (refer to FIG. 2) when the front plate 65 is caused to pivot around the pivot shaft 67, the pivotal motion of the front plate 65 is stable. In the course of the front plate 65 being pivoted, the engaging pin 69 is kept in engagement with the arc portion 45*a* of the guide groove 45 to thereby prevent the slide arm 42 from moving rearward (refer to FIG. 2). As a result, operations of opening the front plate 65 and flipping-up of the opening/closing fallboard unit UNT can be carried out with stability.

When the opening/closing fallboard unit UNT is in the fully open state, the fully open state can be maintained by engaging the engaging pin 69 with the straight portion 45*b* of the guide groove 45. This makes it easy to maintain a state where the space upward of the rear portion KBa of the keyboard section KB is made open toward the player. Since the fully open state is maintained even when the opening/closing fallboard unit UNT is caused to move in unison with the slide arms 42 in the front-to-rear direction, it is unnecessary to support the opening/closing fallboard unit UNT during the sliding movement thereof, which makes it easy to perform an operation for the sliding movement.

In addition, since the arc portion 45*a* and the straight portion 45*b* of the guide groove 45 are formed continuously, the flip-up operation and the slide motion operation of the opening/closing fallboard unit UNT can be made continuously and smoothly, resulting in improved operability at the time of fallboard opening and fallboard accommodation.

When the opening/closing fallboard unit UNT is in the half-open state, due to the own weight of the front plate 65 and the weight of the fallboard 60, the front plate 65 is applied with a rotational moment around pivot shaft 67 exerting in the counterclockwise direction in FIG. 2. In other word, this rotational moment acts in the direction of resisting a shift from the closed state to the open state of the front plate 65. As a result, when the fallboard 60 is caused to open when the opening/closing fallboard unit UNT is in the half-open state, the front plate 65 is suppressed from being pivoted in the opening direction with the operation for opening the fallboard, which makes it easy to perform the operation of opening only the fallboard 60.

According to the present embodiment, light emitted from any one of the LEDs 75 is made visible from the player via the sheet member 73 of the cover member 70 only when the LED 75 emits the light, and therefore, at the time of making operation for performance, it is possible to selectively perform a performance in which the presence of light emitting function is not made conscious or a performance in which light emission is made conscious. At the time of conducting a musical performance with the opening/closing fallboard unit UNT being made in the half-open state, if the LEDs 75 are caused not to emit light, then the presence of the light emission mechanism is not conscious, making it possible to conduct a performance with an acoustic piano-like external appearance.

Since the sheet member 73 covering the through holes 71*a* of the cover body 71 is adopted as a semi-transparent material that allows light from the lens member 72 to pass therethrough, it is possible to fabricate the sheet member 73 at low costs as compared to a case where a number of sheet members are individually fabricated for every through hole 71*a* such that the aforementioned special requirements are satisfied.

Figure 11A:
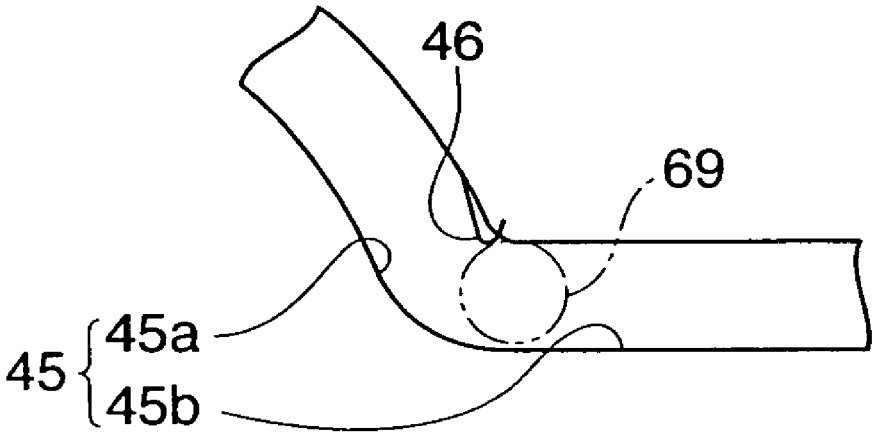
FIG. 11A is a fragmentary side view showing a modification of a guide groove.

In the present embodiment, the half-open state of the opening/closing fallboard unit UNT is retainable due to engagement between the straight portion 45*b* of the guide groove 45 and the engaging pin 69 of the front plate 65. However, this is not limitative. FIG. 11A is a fragmentary side view showing a modification of the guide groove 45. As shown by way of example in FIG. 11A, an elastic piece 46 made of metal or the like may be provided, as a retainer, on an upper surface of an arc portion 45*a* of a guide groove 45 in vicinity of connection between the arc portion 45*a* and the straight portion 45*b*.

The elastic piece 46 is designed to be projected into and retreated from the arc portion 45*a*. Specifically, when the elastic piece 46 is in a free state, it is projected into the inside of the arc portion 45*a* as shown in FIG. 11A, whereas the elastic piece 46 is retreated toward outside when it is depressed from the inside of the arc portion 45*a*. When the front plate 65 is made in the open state so that the engaging pin 69 reaches a rear portion of the arc portion 45*a* and climbs over the elastic piece 46, the engaging pin 69 is caught by the elastic piece 46. As a result, the front plate 65 is made so as not to be pivotable even if the hand is detached, whereby the opening/closing fallboard unit UNT is maintained in the half-open state.

From the view point of simplifying the construction, the mechanism for causing the slide arm 42 to slide may not be provided in the present embodiment. The opening/closing fallboard unit UNT may be constructed to be simply changed over from the fully closed state to the fully open state. In that case, as a mechanism for making the front plate 65 in the open state, there may be adopted a pivotal support of the front plate by means of the pivot shaft 67 or engagement between the engaging pin 69 and the arc portion 45*a* of the guide groove 45. That is, in the present invention, the engaging pin 69 and the guide groove 45 function to assist the sliding motion of the slide arm 42 and the changeover of the front plate 65, and may be removed since they are not inevitably necessary for the present invention. In a case where the pivot shaft 67 for the front plate is not adopted, it is not inevitably necessary to form the arc portion 45*a* of the guide groove 45 into a circular shape as long as it is formed into a shape with which the front plate 65 is ultimately guided into the open state. Even when the pivot shaft 67 for the front plate or the arc portion 45*a* is eliminated, it is preferable that a mechanism, such as the elastic piece 46, for maintaining the fully open state of the opening/closing fallboard unit UNT be provided. In a case where the front plate 65 is pivotally supported only by the pivot shaft 67, it is preferable that a mechanism for maintaining the open state of the front plate 65 be provided in an appropriate place in the instrument body 101.

Figure 11B:
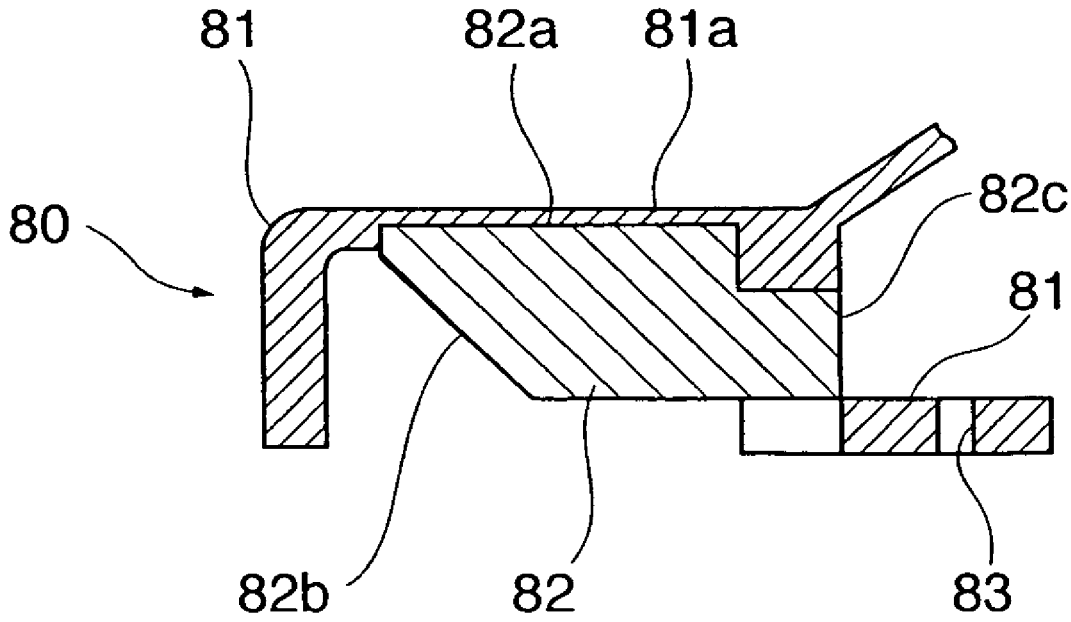
FIG. 11B is a section view showing a modification of the cover member.

Although the sheet member 73 of the cover member 70 is made of a semi-transparent material in the present embodiment, this is not limitative. The cover member 70 is merely required to be configured such that light is made visible from the player via part of the cover member 70 only when any one of the LEDs 75 emits the light. FIG. 11B is a section view showing a modification of the cover member.

As shown by way of example in FIG. 11B, a retaining portion 81 and a lens member (optical display section) 82 may be formed into an integral cover member 80 by means of two color resin molding. The retaining portion 81 is made of a semi-transparent material similar to that for the sheet member 73. The lens member 82 is made of a transparent resin similar to that of the lens member 72, and has an upper surface 82*a*, a slanted surface 82*b*, and a rear end surface 82*c* that are similar to the upper surface 72*a*, the slanted surface 72*b*, and the rear end surface of the lens member 72. The upper surface 82*a* of the lens member 82 is in a facing relation with a lens opposing part (semi-light transparent portion) 81*a* of the retaining portion 81, and the lens opposing part 81*a* is formed as thin as the sheet member 73.

A mounting hole 83 is formed in a lower rear part of the retaining portion 81, and with use of the mounting hole 83, the cover member 80 is mounted to the panel section 10. Although not illustrated, the LEDs 75 are arranged in the same manner as shown in FIG. 9. The lens opposing part 81*a* has the same function as that of the sheet member 73 such that light emitted from the upper surface 82*a* of the lens member 82 is made visible through the lens opposing part 81*a* only when any one of the LEDs 75 emits the light. The just-mentioned construction is simple and easy to fabricate.

In the present embodiment, mechanisms for povitably supporting the front plate 65 and mechanisms for causing the slide arms 42 to slide (the slide guide body 31, the interlocking rod retainer 37, etc.) are provided in the left and right side plates 23 and the cross arms 22. This is not limitative. Supporting section for supporting them may be comprised of parts or members that are fixed to the keybed 21 and provided at two or more locations which are apart from one another in the left-to-right direction.

Although the arc portion 45*a* of the guide groove 45 is configured as a continuous groove, any construction may be adopted so long as it properly engages with the engaging pin 69 and is capable of guiding the engaging pin 69. For example, it may be an intermittent groove which is periodically disconnected in part.

From the viewpoint of constructing the opening/closing fallboard unit UNT such that it can be flipped up in a folded state, the vertical positional relationship between the engaging pin 69 and the pivot shaft 67 for front plate may be reversed. In that case, the direction of opening the front plate 65 is counterclockwise in FIG. 2, and the vertical positional relationship between the arc portion 45*a* of the guide groove 45 and the slide mechanism such as the slide arm 42 is also reversed. As viewed from lateral side, the arc portion 45*a* of the guide groove 45 is not convex toward forward and upward as shown in FIG. 2, but is convex toward rearward and downward.

The sound generating section in the panel section 10 is comprised of the speakers 12. However, the sound generation section provided in the part which is made open to the player when the opening/closing fallboard unit UNT is in the fully open state is not limited to ones for electrically generating sound, but may be ones for generating acoustic sounds using string, sound board, or the like. In particular, solely from the viewpoint of making the section open toward the player to thereby improve the sound generating efficiency, the keyboard instrument 100 is not limited to an electronic instrument but may be an acoustic keyboard instrument.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fallboard structure of a keyboard instrument including an instrument body, a keybed having side portions and provided in the instrument body, and a keyboard section having a rear portion and provided in the instrument body, the fallboard structure comprising:

a pair of left and right supporting portions fixed to the keybed of the instrument body and respectively disposed at the side portions of the keybed;

a pair of left and tight displacement guides provided in inner sides of respective ones of said supporting portions;

a fallboard capable of being selectively operated in either a closed state or an open state, said fallboard coveting the keyboard section in the closed state and permitting the keyboard section to be operated for performance in the open state;

a front plate having side portions and having a width thereof at least equal to that of the keyboard section, said front plate having, at upper end portions of side portions thereof, a pair of left and right engage portions engaged with the pair of left and tight displacement guides, and further having, at lower end portions of side portions thereof, at least a first pivot shaft, said front plate supporting said fallboard so as to be pivotable around said pivot shaft in opening and closing directions, and said front plate capable of being operated in a first performance state of posture in which a space upward of the rear portion of the keyboard section against a player is shielded, and in a second performance state of posture in which the space upward of the rear portion of the keyboard section is made open toward the player, wherein when said fallboard is in the open state and each of said engaging portions of said front plate is caused to move along a corresponding one of the displacement guides, said front plate is caused to move in unison with said fallboard and changed from the first performance state of posture to the second performance state of posture, thereby causing the space upward of the rear portion of the keyboard section to be open toward the player;

wherein said fallboard and said front plate are in a folded state in which they face each other when said fallboard is in the open state, and when said fallboard is in the open state and said front plate is in the second performance state of posture, said fallboard and said front plate can be accommodated into the instrument body by causing them to slidingly move in a rearward direction.

2. A fallboard structure of a keyboard instrument according to claim 1, further comprising:

a pair of left and right pivotably holding members each having a second pivot shaft and provided in the instrument body, said pivotably holding members supporting said front plate so as to be pivotable around said second pivot shafts, said second pivot shafts being located upward of said first pivot shaft when said front plate is in the first performance state of posture, wherein when said fallboard is in the open state and said front plate is caused to rotate around said second pivot shafts, said front plate is caused to be pivoted together with said fallboard so that said front plate is changed from the first performance state of posture to the second performance state of posture, thereby causing the space upward of the rear portion of the keyboard section to be open toward the player.

3. A fallboard structure of a keyboard instrument according to claim 2, wherein each of said pair of left and right displacement guides has an arc portion thereof extending around said second pivot shaft.

4. A fallboard structure of a keyboard instrument according to claim 3, wherein when said front plate is not in the second performance state of posture, the privotably holding member is prevented from slidingly moving in a rearward direction due to engagement between the arc portion of said displacement guide and said engaging portion.

5. A fallboard structure of a keyboard instrument according to claim 2, wherein:

when said front plate is in the first performance state of posture, said second pivot shafts are located upward of said first pivot shaft, and rotational moment around said second pivot shafts generated due to application of weight of said fallboard via said first pivot shaft to said front plate when said front plate is in the first performance state of posture is exerted in a direction for resisting changeover of said front plate from the first performance state of posture to the second performance state of posture.

6. A fallboard structure of a keyboard instrument according to claim 2, further comprising:

a cover member having a semi light-transparent portion and located at a location that is visible through a gap between said front plate placed in the first performance state of posture and the keyboard section, said cover member being disposed so as to cover the rear portion of the keyboard section; and a plurality of optical display sections disposed inside said cover member so as to correspond to respective ones of the plurality of keys of the keyboard section, light being visible through the semi light-transparent portion from the player only when any one of said optical display sections emits light having not less than predetermined brightness.

7. A fallboard structure of a keyboard instrument according to claim 6, wherein said cover member is comprised of a cover body and said semi light-transparent portion, and said semi light-transparent portion is comprised of a sheet member having a semi-light transparency and disposed to face said optical display sections in said cover body.

8. A fallboard structure of a keyboard instrument according to claim 1, further comprising at least one retainer for maintaining said front plate in the second performance state of posture.

9. A fallboard structure of a keyboard instrument according to claim 8, wherein said retainer is a longitudinal motion guide portion of each of said displacement guides, which is provided in a front-to-rear direction so as to be formed continuously with said arc portion and configured to maintain said fallboard in the open state and maintain said front plate in the second performance state of posture when said pivotably holding member is in a slide motion process.

10. A fallboard structure of a keyboard instrument according to claim 1, further comprising at least one electronic instrument functional element disposed in the space upward of the rear portion of the keyboard section that is open toward the player when said front plate is in the second performance state of posture.

* * * * *